US011505424B2

(12) United States Patent
Snyder et al.

(10) Patent No.: US 11,505,424 B2
(45) Date of Patent: Nov. 22, 2022

(54) POWERED REWIND APPARATUS

(71) Applicants: Lonny Snyder, Linwood, MI (US); Cody Snyder, Linwood, MI (US)

(72) Inventors: Lonny Snyder, Linwood, MI (US); Cody Snyder, Linwood, MI (US)

( * ) Notice: Subject to any disclaimer, the term of this patent is extended or adjusted under 35 U.S.C. 154(b) by 537 days.

(21) Appl. No.: 16/701,893

(22) Filed: Dec. 3, 2019

(65) Prior Publication Data

US 2021/0163256 A1 Jun. 3, 2021

(51) Int. Cl.
*B65H 54/54* (2006.01)
*B65H 75/44* (2006.01)

(52) U.S. Cl.
CPC ..... *B65H 75/4484* (2013.01); *B65H 54/54* (2013.01); *B65H 2701/30* (2013.01)

(58) Field of Classification Search
CPC ..... B65H 54/12; B65H 54/54; B65H 54/106; B65H 54/543; B65H 75/4484; B65H 2701/30
See application file for complete search history.

(56) References Cited

U.S. PATENT DOCUMENTS

| | | | | |
|---|---|---|---|---|
| 2,793,820 | A * | 5/1957 | Torgeson | B65H 54/44 242/406 |
| 3,863,859 | A * | 2/1975 | Keith | B65H 49/32 242/399.2 |
| 3,973,739 | A | 8/1976 | Nilgsens et al. | |
| 4,782,286 | A | 8/1988 | Crow | |
| 5,370,326 | A | 12/1994 | Webb | |
| 7,530,520 | B2 * | 5/2009 | Jones | B65H 54/54 242/403 |
| 8,367,725 | B2 | 2/2013 | Yokoyama | |
| 10,156,111 | B2 | 12/2018 | Clemens et al. | |
| 2018/0346280 | A1 * | 12/2018 | Franck | B65H 54/106 |

* cited by examiner

*Primary Examiner* — Sang K Kim

(57) ABSTRACT

A device that is used to rewind loose cable and wire that is typically accomplished by hand, that is, no power is available for driving such apparati. This device is adaptable to, and uses the already existing power on a service truck to power the device.

1 Claim, 2 Drawing Sheets

POWERED REWIND APPARATUS

CROSS REFERENCE TO RELATED APPLICATIONS

To the applicant's knowledge, there are no related applications to this application.

BACKGROUND OF THE INVENTION

To the applicant's knowledge, there are no similar apparati available in the commercial field. The instant invention deals with a device that is used to rewind loose cable and wire that is typically accomplished by hand, that is, no power is available for driving such apparati.

This invention uses the already existing power on a service truck to power the device. Typically, after an installation project, all unused wire and/or cable has to be rewound on wood or plastic spools and in order to do this, current practice is to do so with manual rewind devices. Some rewind projects may consist of hundreds of, if not yards of, loose cable or wire, for example, typically, 300 to 400 feet of loose wire and cable.

Service trucks in the industry have a power source mounted on them for drilling holes in the ground for the placement of poles and the like, that would allow the workers to rewind cable or wire if there was equipment that could be adapted to the power source on the service truck.

Mechanical devices useful in the art consist of that disclosed in U.S. Pat. No. 3,973,739, that issued Aug. 10, 1976 to Nilgens et. al. in which there is disclosed a high-speed winding apparatus for producing a filamentary spool package on a spool sleeve. The device is specifically designed for the winding of filaments, threads, yarns or the like as employed in spin-drawing and high-speed spinning machines.

U.S. Pat. No. 4,762,286 that issued Aug. 9, 1988 to Crow deals with a device for rewinding line onto a spool. The patent deals with a biased spool using a spring mechanism and is hand crank driven.

U.S. Pat. No. 5,370,326 that issued Dec. 6, 1994 to Webb deals with a device used for winding line from a bulk supply onto a reusable spool. This patent also deals with a biased spool so that one can tighten to allow the spool to rotate. It is driven by hand crank.

Goodwin, in U.S. Pat. No. 6,367,725 that issued Apr. 9, 2002 discloses a wire spooler/distributor for dispensing electrical wire during the installation of electrical wiring at a construction site. The device does not seem to be power driven.

In U.S. Pat. No. 10,156,111, that issued Dec. 18, 2018, to Clemens et al deals with a special wire retrieval device to cut and recover wire or cable from a well.

None of the prior art discussed Supra discloses or makes obvious the device of the instant invention.

DETAILED DESCRIPTION OF THE DRAWINGS

Figure 1:
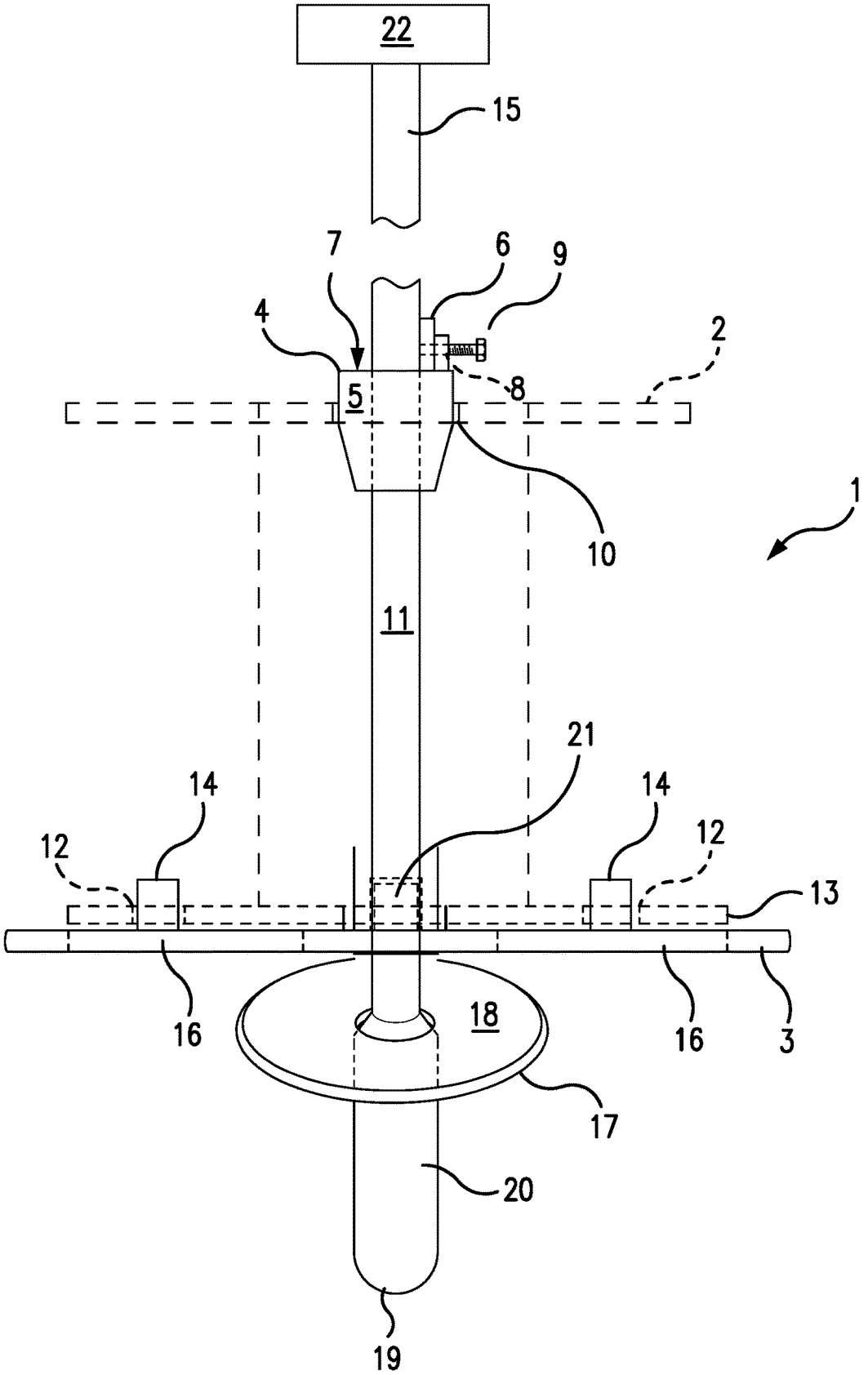
FIG. 1 is a full side view of the device of this invention.

Turning now to FIG. 1, there is shown a full side view of the device 1 of this invention. Shown is a take-up spool 2 (in phantom) resting on support bar 3. At the top of the take-up spool 2 there is shown a retainer assembly 4 which is composed of a retainer plug 5 and an attachment bar 6 that is welded to the top 7 of the retainer plug 5. Inserted in the threaded opening 8 is a threaded bolt or screw 9. Upon inserting the retainer plug assembly 4 into the opening 10 in the end of the take up spool 2 and then tightening the threaded screw 9 against the drive shaft 11, the take-up spool 2 is retained on the support bar 3. This device is critical to the smooth operation of the device 1, as if this retainer assembly is not used, the take-up spool 2 wobbles and moves around in the opening of the take-up spool and the cable and wire cannot be wrapped smoothly. In addition, the movement of the spool eventually wears the hole in the center such that the spool does not work anymore. Openings 12 in the side of the take up spool 2 allow for the retainer shafts 14 to hold the bottom 13 of the take-up spool 2 such that the take-up spool 2 will turn with the turning of the power shaft 15. As noted, the retainer shafts 14 are slidable in the elongated openings 16 in the support bar 3, therefore, adjustable to accommodate various sizes of spools.

Located some distance below the support bar 3 is a disc 17 (ground support plate) with a concave surface 18. Just below the disc 17 there is shown the bottom end 19 of the shaft 20. During use, the bottom end 19 of the shaft 20 is pushed into the soil and as the device rotates, the bottom end 19 also rotates, however, it does not drill, but only sinks into the soil a certain amount to stabilize the device 1 while in use as can be observed by noting the rounded bottom end of the shaft. The concave disc 17 serves to prevent the device from sinking too far into the ground.

There is a square or hexagonal centered spindle 21 which is integrally fixed to the shaft 20. An elongated drive shaft 11 is assembled with the retainer assembly 4 slidable on the drive shaft 11. Thereafter, the drive shaft 11 is inserted through the centered opening 10 in the take-up spool 2 and centered over the centered spindle 21 and connected thereto. Thereafter, the retainer assembly 4 is plugged into the top centered opening 10 in the take-up spool 2 and tightened to the drive shaft 11. Finally, the drive shaft 11 is attached to the power source 22 for driving the drive shaft 11.

The power source 22 and the take-up spool 2 are not part of this invention.

Figure 2:
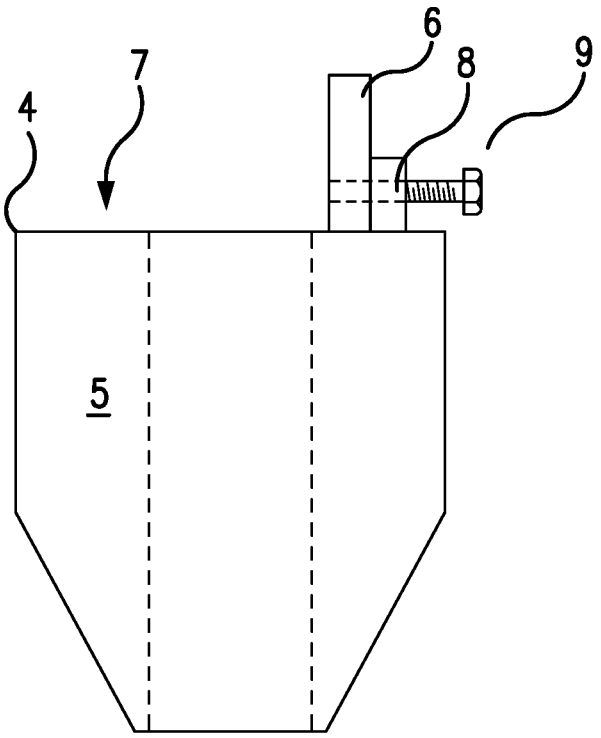
FIG. 2 is an enlarged retainer assembly.

Turning now to FIG. 2, for more clarity regarding the retainer assembly 4, there is shown a side view of the retainer assembly 4 wherein there is shown the retainer plug 5, attachment bar 6, the top 7 of the retainer plug 5, a threaded opening 8 in the attachment bar 6 and a threaded bolt 9. Shown in phantom is the centered opening.

Figure 3:
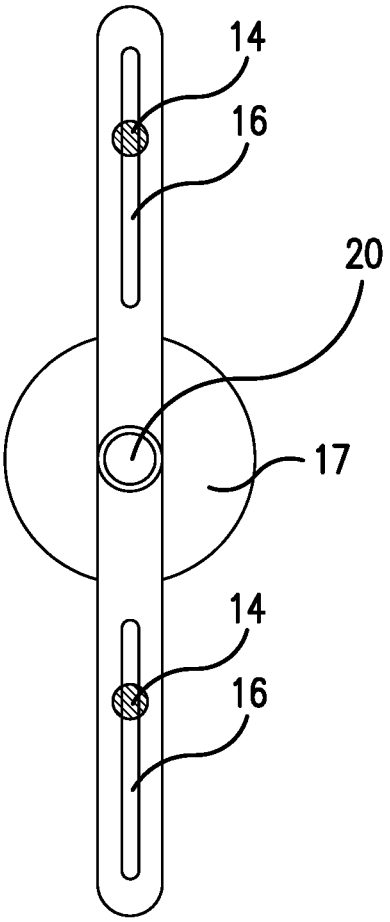
FIG. 3 is an enlarged top view of the support bar and disc.

FIG. 3 deals with details of the support bar 3, in that, shown is a full top view of the bar 3 with the concave surface 18 of the disc 17 showing. In addition, there is shown the elongated openings 16 in the support bar 3. The shaft 20 is also shown.

Figure 4:
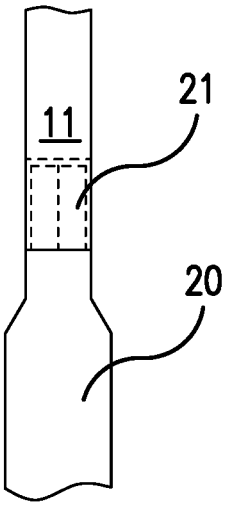
FIG. 4 is a partial enlarged view of the coupling of the drive shaft to the centered spindle.

Finally, turning now to FIG. 4, there is shown a partial view of the connection between the drive shaft 11 and the centered spindle 21.

In use, the shaft under the support bar and disc assembly is punched into the ground. The take-up spool is mounted over the centered spindle through the centered opening in the take-up spool. The retainer assembly is slid onto the drive shaft and the drive shaft is inserted through the top centered opening of the take-up spool and the retainer plug is inserted into the opening and the threaded bolt is turned into the drive shaft. The drive shaft is coupled to the power source and the wire or cable to be retrieved is fastened to the take-up spool and the power turned on. It is a beneficial action to manually guide the wire or cable as it is being rewound on the spool. After the wire or cable is on the spool, the device is dissembled.

The device of this invention can be manufactured from wood or metal, metal being preferred.

What is claimed is:

1. A powered rewind apparatus, said powered rewind apparatus comprising in combination:

(A) a bottom component comprising:

a support shaft, said support shaft having a bottom tip end and a ground support plate, said ground support plate located encircling said support shaft at a predetermined distance from said bottom tip end;

said support shaft having a top end, there being mounted on said top end, an elongated flat bar having a predetermined length, said flat bar having elongated openings therethrough;

there being two retainer shafts, mountable in, and slidable along said elongated openings;

a centered spindle located in a center of said top end of said support shaft;

an elongated drive shaft, said elongated drive shaft having a first end and a second end, said first end being configured to set over and couple said centered spindle, said second end configured to attach to a mechanical drive;

(B) a top component comprising a slidable retainer assembly, said slidable retainer assembly slidable on said drive shaft and comprised of:

a hub, said hub having a cone-shaped configuration and a centered opening therethrough, said hub having fixedly attached to an outside top surface of said hub, a mechanical attachment means consisting of an upright metal bar, said metal bar having a threaded hole therethrough, a threaded bolt in said threaded opening.

* * * * *